US011322129B2

(12) United States Patent
Tanaka et al.

(10) Patent No.: US 11,322,129 B2
(45) Date of Patent: May 3, 2022

(54) SOUND REPRODUCING APPARATUS, SOUND REPRODUCING METHOD, AND SOUND REPRODUCING SYSTEM

(71) Applicant: Yamaha Corporation, Hamamatsu (JP)

(72) Inventors: Mitsuki Tanaka, Hamamatsu (JP); Yukio Tada, Iwata (JP); Kazuya Kumehara, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 17/175,369

(22) Filed: Feb. 12, 2021

(65) Prior Publication Data

US 2021/0256951 A1 Aug. 19, 2021

(30) Foreign Application Priority Data

Feb. 18, 2020 (JP) ..... JP2020-025529

(51) Int. Cl.
*G10K 11/178* (2006.01)

(52) U.S. Cl.
CPC .. *G10K 11/17827* (2018.01); *G10K 11/17873* (2018.01); *G10K 11/17885* (2018.01); *G10K 2210/1081* (2013.01); *G10K 2210/3011* (2013.01); *G10K 2210/3027* (2013.01); *G10K 2210/3036* (2013.01)

(58) Field of Classification Search
CPC ..... G10K 11/17827; G10K 11/17873; G10K 11/17885; G10K 2210/1081; G10K 2210/3011; G10K 2210/3027; G10K 2210/3036
USPC ..... 381/71.6
See application file for complete search history.

(56) References Cited

U.S. PATENT DOCUMENTS

2001/0046304 A1* 11/2001 Rast ..... H04R 1/1041 381/74
2018/0341982 A1* 11/2018 Gotoh ..... G01C 21/3476

FOREIGN PATENT DOCUMENTS

JP 2017-103598 A 6/2017

* cited by examiner

*Primary Examiner* — Paul Kim
*Assistant Examiner* — Douglas J Suthers
(74) *Attorney, Agent, or Firm* — Crowell & Moring LLP

(57) ABSTRACT

A sound reproducing apparatus includes a speaker, a microphone, and at least one processor. The at least one processor performs a process that includes hear-through processing and noise cancellation processing. The process also includes a storage task and a reading task. When detecting an occurrence of the trigger, the reading task reads control information of the event information of which execution is instructed by the trigger. The reading task also executes the hear-through processing and the noise cancellation processing in the signal processing task.

15 Claims, 6 Drawing Sheets

SCENARIO FILE 721

| No | TRIGGER TYPE | TRIGGER | EXTERNAL SOUND CONTROL | REPRODUCED SOUND | LOCALIZATION POSITION |
|---|---|---|---|---|---|
| 1 | PLACE | P1 | HT:50 ANC:50 | ROUTE GUIDANCE (R1) | LEFT SIDE (RELATIVE POSITION) |
| 2 | ROUTE | R1 | HT:70 ANC:0 | COMMENTARY OF PARK 500 | LEFT SIDE (RELATIVE POSITION) |
| 3 | PLACE | P2 | HT:50 ANC:50 | ROUTE GUIDANCE (R2) | LEFT SIDE (RELATIVE POSITION) |
| 4 | ROUTE | R2 | HT:100 ANC:0 | SOUND OF ANIMATION | ON STAGE (ABSOLUTE POSITION) |
| 5 | PLACE TIME | P3 ONE-MINUTE STAY | HT:0 ANC:100 | LINE OF EACH CHARACTER | DISPOSED ON STAGE (ABSOLUTE-RELATIVE POSITION) |
| 6 | PLACE | P3 | HT:50 ANC:50 | ROUTE GUIDANCE (R3) | LEFT SIDE (RELATIVE POSITION) |
| 7 | ROUTE | R3 | HT:100 ANC:0 | – | – |
| 8 | PLACE | P4 | HT:0 ANC:100 | QUIZ | FRONT SIDE (RELATIVE POSITION) |
| 9-1 | CORRECT ANSWER | P4 | HT:50 ANC: 50 | ROUTE GUIDANCE (R4) | LEFT SIDE (RELATIVE POSITION) |
| 10 | ROUTE | R4 | HT:70 SIGNAL PROCESSING ANC:100 | SOUND OF ANIMATION | ON ISLAND (ABSOLUTE POSITION) |
| 9-2 | INCORRECT ANSWER | P4 | HT:50 ANC:50 | ROUTE GUIDANCE (R5) | LEFT SIDE (RELATIVE POSITION) |
| 11 | ROUTE | R5 | HT:100 SIGNAL PROCESSING ANC:100 | – | – |

FIG.5

SCENARIO FILE 721

| No | TRIGGER TYPE | TRIGGER | EXTERNAL SOUND CONTROL | REPRODUCED SOUND | LOCALIZATION POSITION |
|---|---|---|---|---|---|
| 1 | PLACE | P1 | HT:50 ANC:50 | ROUTE GUIDANCE (R1) | LEFT SIDE (RELATIVE POSITION) |
| 2 | ROUTE | R1 | HT:70 ANC:0 | COMMENTARY OF PARK 500 | LEFT SIDE (RELATIVE POSITION) |
| 3 | PLACE | P2 | HT:50 ANC:50 | ROUTE GUIDANCE (R2) | LEFT SIDE (RELATIVE POSITION) |
| 4 | ROUTE | R2 | HT:100 ANC:0 | SOUND OF ANIMATION | ON STAGE (ABSOLUTE POSITION) |
| 5 | PLACE TIME | P3 ONE-MINUTE STAY | HT:0 ANC:100 | LINE OF EACH CHARACTER | DISPOSED ON STAGE (ABSOLUTE-RELATIVE POSITION) |
| 6 | PLACE | P3 | HT:50 ANC:50 | ROUTE GUIDANCE (R3) | LEFT SIDE (RELATIVE POSITION) |
| 7 | ROUTE | R3 | HT:100 ANC:0 | — | — |
| 8 | PLACE | P4 | HT:0 ANC:100 | QUIZ | FRONT SIDE (RELATIVE POSITION) |
| 9-1 | CORRECT ANSWER | P4 | HT:50 ANC: 50 | ROUTE GUIDANCE (R4) | LEFT SIDE (RELATIVE POSITION) |
| 10 | ROUTE | R4 | HT:70 SIGNAL PROCESSING ANC:100 | SOUND OF ANIMATION | ON ISLAND (ABSOLUTE POSITION) |
| 9-2 | INCORRECT ANSWER | P4 | HT:50 ANC:50 | ROUTE GUIDANCE (R5) | LEFT SIDE (RELATIVE POSITION) |
| 11 | ROUTE | R5 | HT:100 SIGNAL PROCESSING ANC:100 | — | — |

SOUND REPRODUCING APPARATUS, SOUND REPRODUCING METHOD, AND SOUND REPRODUCING SYSTEM

CROSS REFERENCE TO RELATED APPLICATIONS

This Nonprovisional application claims priority under 35 U.S.C. § 119(a) on Patent Application No. 2020-025529 filed in Japan on Feb. 18, 2020 the entire contents of which are hereby incorporated by reference.

BACKGROUND

Technical Field

The present disclosure relates to a sound reproducing apparatus using an audio device that is able to turn on or off the output of external sound to a user.

An AR (Augmented Reality) system that causes a user to experience audio Augmented Reality. An audio AR system causes a user to wear audio devices such as headphones or earphones, and emits a voice according to a place in which the user stays, from the audio devices. An information processing apparatus may be applied, for example, to contents tourism. The information processing apparatus outputs a voice to guide a user to a predetermined point according to the position of the user, in a place related to content such as animation, in the voice of a character in the animation.

In a case of contents tourism, the AR system reproduces content such as animation, a movie, or a drama, in a place related to the content. On the other hand, it is important for the AR system not only to reproduce content, but to cause a user to experience environmental sound of a place related to the content. However, in the conventional AR system, the sound to be reproduced to a user is only sound related to content such as the voice of a character. For this reason, even when the conventional AR system may be able to reproduce content, it was not possible to cause a user to experience the environmental sound of a place related to the content through the AR system.

SUMMARY

An object of an embodiment of the present disclosure is to provide a sound reproducing apparatus that is able to cause a user to experience environmental sound by appropriately outputting external sound to the user.

A sound reproducing apparatus according to an embodiment of the present disclosure includes a speaker that emits sound toward an ear of a user, a microphone that collects external sound arriving at the user, and at least one processor that executes a process by reading and executing instructions stored in a memory, the process including a signal processing task that executes hear-through processing to supply the external sound to the speaker, and noise cancellation processing to generate cancellation sound that cancels the external sound and to supply the cancellation sound to the speaker, a storage task that stores control information that specifies a function level of each of the hear-through processing and the noise cancellation processing, and event information including information on a trigger that is an event to instruct event execution, and a reading task that, when detecting an occurrence of the trigger, reads control information of the event information of which the execution is instructed by the trigger, and executes the hear-through processing and the noise cancellation processing in the signal processing task.

According to an embodiment of the present disclosure, external sound is able to be appropriately outputted to a user, so that the user can be caused to experience environmental sound of a place in which the user is present.

Other objects, advantages and novel features of the embodiments of the present disclosure will become apparent from the following detailed description of one or more preferred embodiments when considered in conjunction with the accompanying drawings.

BRIEF DESCRIPTION OF THE DRAWINGS

FIG. 5 is a diagram showing an example of a scenario in a case in which the sound reproducing system guides a user to a park.

DETAILED DESCRIPTION

Figure 1:
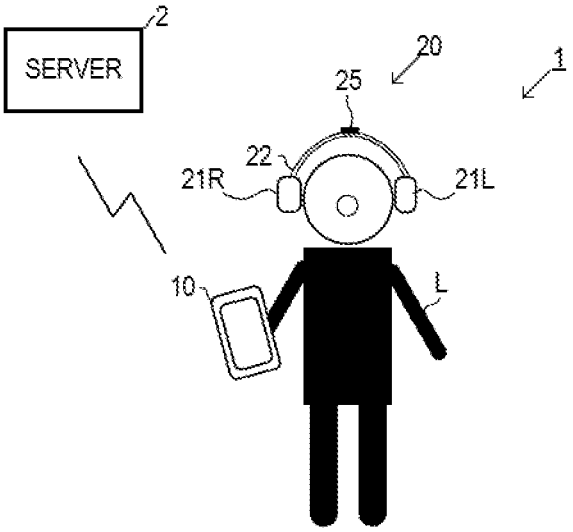
FIG. 1 is a diagram showing a configuration of a sound reproducing system.

A sound reproducing apparatus according to an embodiment of the present disclosure includes a speaker, a microphone, a signal processor, a storage, and a controller. The speaker emits sound toward an ear of a user. The microphone collects external sound arriving at the user. The signal processor executes hear-through processing to supply the external sound to the speaker, and noise cancellation processing to generate cancellation sound that cancels the external sound and to supply the cancellation sound to the speaker. The storage stores control information that specifies a function level of each of the hear-through processing and the noise cancellation processing, and event information including trigger information that is an event to instruct event execution. The controller, when detecting the occurrence of the trigger, reads control information of the event information of which the execution is instructed by the trigger, and outputs the control information to the signal processor. It is to be noted that each of the signal processor, the storage, and the controller may be implemented by hardware. Alternatively, a processor reads instructions stored by a memory and executes each configuration as a task, so that each of the signal processor, the storage, and the controller may be implemented.

The control information may include information that controls the signal processor in any of a noise cancellation mode, a hear-through mode, and an intermediate mode. The noise cancellation mode is a mode in which the noise cancellation processing is executed at 100% and the hear-through processing is not executed. The hear-through mode is a mode in which the noise cancellation processing is not executed and the hear-through processing is executed at 100%. The intermediate mode is a mode in which the noise cancellation processing is executed at less than 100%, and the hear-through processing is executed at less than 100%.

The signal processor, when switching the function level of the noise cancellation processing or the hear-through processing, may switch the function level by fade processing that gradually changes the function level.

The control information may include information to instruct adjustment of sound quality of the external sound to be supplied to the speaker by the hear-through processing. In such a case, the signal processor, when receiving the control information to instruct the adjustment of the sound quality of the external sound, executes processing to adjust the sound quality of the external sound.

The sound reproducing apparatus may further include a sound generator that reproduces audio data and outputs the sound as internal sound to the signal processor. In such a case, the storage stores event information including audio data. The controller, when detecting the occurrence of the trigger, reads control information of the event information of which the execution is instructed by the trigger and outputs the control information to the signal processor, outputs the audio data of the event information to the sound generator, and causes the sound generator to reproduce sound. The signal processor mixes the internal sound that the sound generator has been outputted, with the external sound and/or the cancellation sound, and supplies mixed sound to the speaker. The sound to be mixed with the internal sound is only the cancellation sound in the noise cancellation mode, only the external sound in the hear-through mode, and both the external sound and the cancellation sound in the intermediate mode.

The storage may store a plurality of pieces of event information edited as a scenario in order to guide a user to a place related to animation, a movie, or a drama.

Figure 2:
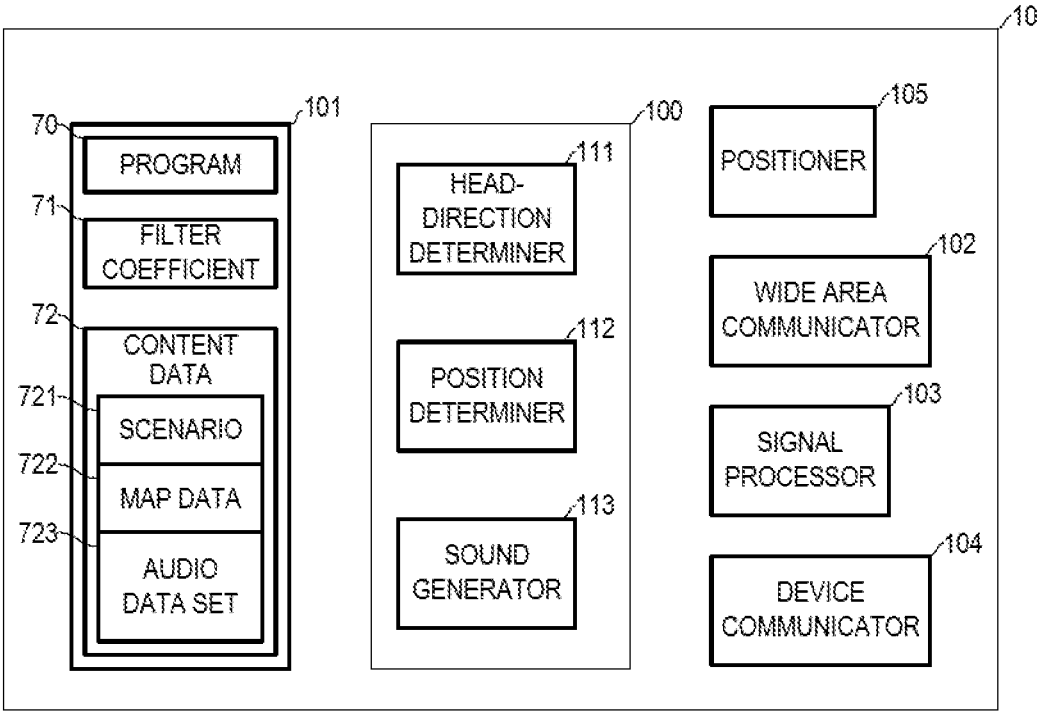
FIG. 2 is a block diagram of a portable terminal device of the sound reproducing system.
Figure 3:
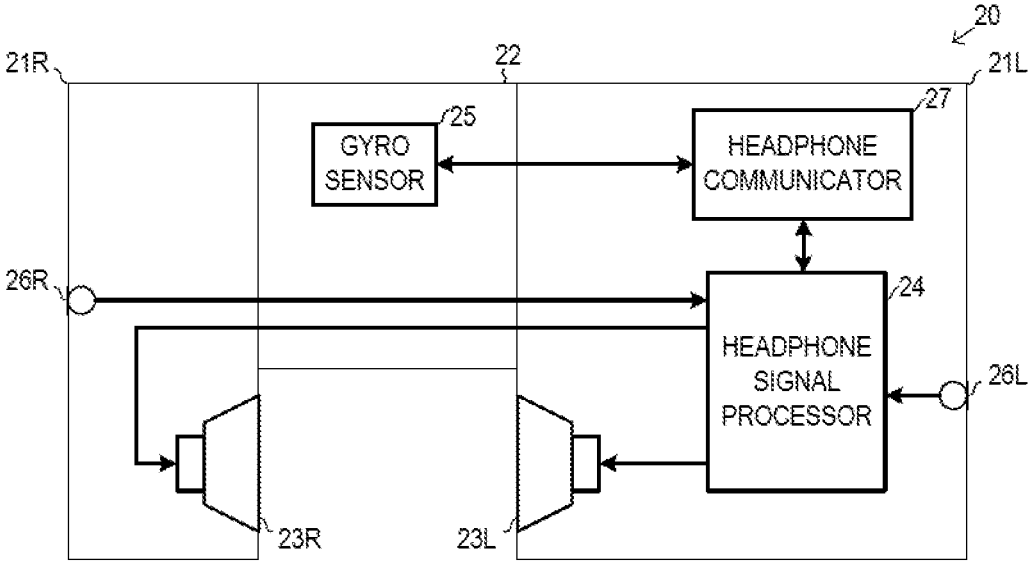
FIG. 3 is a block diagram of headphones of the sound reproducing system.

FIG. 1 is a diagram showing a configuration of a sound reproducing system 1 to which the present disclosure is applied. The sound reproducing system 1 includes a portable terminal device 10, and headphones 20 being an audio device. FIG. 2 is a block diagram of the portable terminal device 10 of the sound reproducing system 1. FIG. 3 is a block diagram of the headphones 20 of the sound reproducing system 1.

FIG. 1 illustrates an example in which a user L holds the portable terminal device 10 in hand, and wears the headphones 20. As the portable terminal device 10, a smart phone (a multifunctional portable phone) is used, for example. The portable terminal device 10 and the headphones 20 are connected by Bluetooth (a registered trademark) and communicable to each other. The connection between the portable terminal device 10 and the headphones 20 is not limited to by Bluetooth, but may be by other wireless or wired communication standards. The portable terminal device 10 communicates with a server 2 through a portable telephone communication network or Wi-Fi (a registered trademark).

The headphones 20 includes a housing 21L, a housing 21R, and a headband 22. The housings 21L and 21R on right and left sides are shaped to be connected by the headband 22. The headphones 20 are so called ear-hook type headphones. The right housing 21R includes a speaker 23R on the right side, and the left housing 21L includes a speaker 23L on the left side. The headphones 20 include a three-axis gyro sensor 25 in the headband 22. The gyro sensor 25, by Coriolis force, detects the front and rear inclination, right and left inclination, and the angle of horizontal rotation of the head of the user L. The headphones 20 track the direction of the head of the user L by the gyro sensor 25. It is to be noted that earphones of which the right and left speakers 23L and 23R are not connected by the headband 22 may be used as an acoustic device. In such a case, the gyro sensor 25 may be provided near the right and left speakers 23L and 23R or in another place.

The headphones 20 include a function to execute active noise cancellation (ANC) processing and hear-through (HT) processing. The active noise cancellation processing is processing in which leak sound being sound obtained when external sound (environmental sound) is transmitted to the housings 21L and 21R and reaches the ear of the user L is cancelled so as to provide a quiet acoustic environment with the user L. Specifically, the headphones 20 perform the following process. External microphones 26L and 26R collect external sound, and obtain a sound collection signal. A headphone signal processor 24 filters the sound collection signal with a transfer function showing the leakage characteristics of the housings 21L and 21R, and obtains the waveform of the leak sound. The headphone signal processor 24 generates cancellation sound being an opposite phase signal of the leak sound, and emits sound from the right and left speakers 23L and 23R. Accordingly, the leak sound is canceled.

The hear-through processing is processing to provide an acoustic environment in which the user L feels as if the user L does not wear the headphones 20. Specifically, the headphones 20 perform the following process. The external microphones 26L and 26R collect external sound, and obtain a sound collection signal. The headphone signal processor 24 filters the sound collection signal and adjusts the sound quality so as to be similar to the sound quality when the user L directly listens to the external sound. The headphone signal processor 24 emits sound of the adjusted sound collection signal from the right and left speakers 23L and 23R. The external sound that is able to be heard directly as air vibration and the sound of the signal with the same waveform as the external sound, the sound being emitted from the speakers 23L and 23R, are sound with a different sound quality to the user L. The headphone signal processor 24 does not emit sound of the sound collection signal from the speakers 23L and 23R as it is, but filters the sound collection signal by a filter coefficient that corrects the difference of the sound quality between the sound collection signal and the actual external sound. As a result, the user L can feel as if the user L were listening to the external sound directly without using the headphones 20.

The headphones 20 adjust the function level of the active noise cancellation processing and the hear-through processing according to an external sound control command to be sent from the portable terminal device 10.

The portable terminal device 10 reproduces audio data stored in the storage 101. The portable terminal device 10 performs localization control so that reproduced sound may be heard from a predetermined position. This localization control is performed using a head-related transfer function. The head-related transfer function is the following function. The sound that arrives at both ears of a user from a sound source position may have specific frequency characteristics according to an arrival direction in response to influence such as a head shape or auricle shape of the user L. The user L distinguishes the specific frequency characteristics, and determines the arrival direction of the sound. The head-related transfer function is a transfer function of sound from a sound source position to the ear canal of both ears of the user L. The portable terminal device 10 filters the sound using the head-related transfer function (a head impulse response). As a result, the user L, when listening to sound through the headphones 20, can have a feeling as if the sound has been heard from a predetermined direction.

The sound reproducing system 1 is used for contents tourism, for example. The contents tourism is defined as a short trip around places related to animation and the like, such as a place used as a setting for animation, a movie, a drama, or the like (hereinafter referred to as animation or the like). The sound reproducing system 1, in the contents tourism, reproduces sound and the like of a voice that guides a user to a place used as a setting, and sound in one scene of animation or the like. Content data 72 being data to be used for the contents tourism is stored in the storage 101 of the portable terminal device 10. The sound reproducing system 1, based on the content data 72, performs reproduction of sound according to a place or timing, control of sound image localization, and switching of the external sound control (the active noise cancellation processing and the hear-through processing).

FIG. 2 is a block diagram of the portable terminal device 10. The portable terminal device 10 is a smartphone including a controller 100, a storage 101, a signal processor 102, a wide area communicator 103, a device communicator 104, and a positioner 105, in terms of hardware. The controller 100 includes a microcomputer incorporating a CPU, a ROM, and a RAM. The storage 101 includes a flash memory being a nonvolatile memory.

The storage 101 stores a program 70, a filter coefficient 71, and content data 72. The program 70 is an application program that causes the portable terminal device 10 and the headphones 20 to function as the sound reproducing system 1. The filter coefficient 71 is a head impulse response obtained by developing on the time axis a head-related transfer function for causing sound to be localized in a predetermined direction to the user L, and is used as a coefficient of a FIR filter. The content data 72 is a data set necessary when the sound reproducing system 1 is used in the contents tourism.

Figure 4:
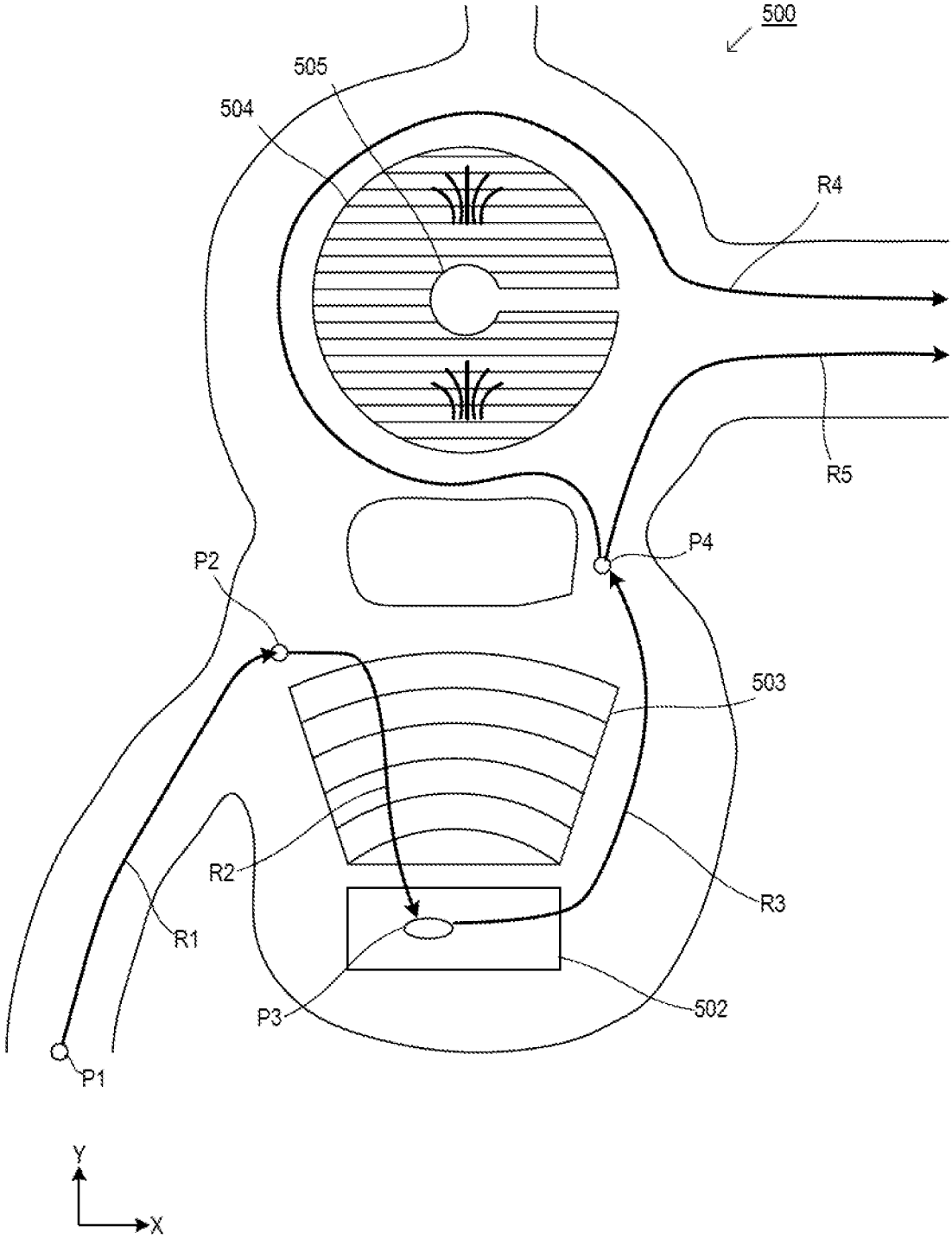
FIG. 4 is a diagram showing a map of a park to which the sound reproducing system guides a user.

The content data 72 includes a scenario file 721, map data 722, and an audio data set 723. The map data 722 is data that stores a passage and object of a place used as a setting for animation or the like as shown in FIG. 4, for example, with a coordinate value. The scenario file 721 is a file that stores information such that, when the user L visits a place in the map data 722, which audio data is reproduced in which place or at which timing, what type of external sound control is performed, and the like. The scenario file 721 includes a configuration as shown, for example, in FIG. 5. The audio data set 723 includes a plurality of pieces of audio data to be reproduced in the contents tourism. The audio data set 723 includes sound to give commentary on a place of contents tourism, and sound such as a line that a performer (a character) has delivered in animation shot in this place as a setting.

The controller 100, by collaboration with the program 70, functions as a head-direction determiner 111, a position determiner 112, and a sound generator 113.

The head-direction determiner 111 determines the direction of the head of the user L. The direction of the head of the user L is information that shows which direction the user faces in which direction on the map shown, for example, in FIG. 4. The head-direction determiner 111 obtains angular velocity information on the head of the user L from the gyro sensor 25 of the headphones 20. The head-direction determiner 111 calculates the rotation angle of the head of the user L by integrating the obtained angular velocity information, and determines the current direction of the head by adding the rotation angle to an initial head direction. The processing to previously measure the initial head direction of the user L is called calibration. The head-direction determiner 111, when the user L stands at a point P1 being an entrance of a park 500, determines that the user L faces in a route R1 direction, and sets the route R1 direction as the initial head direction. The controller 100, based on the determined current head direction, determines in which direction the reproduced sound is localized.

The position determiner 112 obtains positioning information from the positioner 105. The position determiner 112, based on the positioning information, determines where on the map shown, for example, in FIG. 4 the user L is present.

The sound generator 113 generates sound based on the audio data of the audio data set 723. The sound generator 113, in a case in which the audio data is waveform data such as PCM or the like, reproduces the waveform data. The sound generator 113, in a case in which the audio data is speech synthesis information such as MIDI or the like, configures a soft synthesizer, and synthesizes the sound. The sound to be generated by the sound generator 113 and sent to the headphones 20 is called internal sound. The sound generator 113 may be configured by hardware such as, for example, a DSP that is different from the controller 100. In such a case, the sound generator 113 and a signal processor 102 to be described below may share hardware.

The signal processor 102 includes a DSP. The signal processor 102, based on the position of the user L determined by the position determiner 112 and the direction of the head of the user L determined by the head-direction determiner 111, performs filtering so that the reproduced sound is localized at a target position. A filter to be used for the filtering is a FIR filter with a head impulse response as a filter coefficient. In addition, the signal processor 102 may perform filtering to adjust the sound quality of the reproduced sound.

The wide area communicator 103 communicates with a remote device through a portable telephone communication network such as LTE and 5G. Specifically, the wide area communicator 103 communicates with the server 2. The server 2 stores a plurality of pieces of content data 72. The portable terminal device 10 accesses the server 2, and downloads the content data 72 to be used in the contents tourism. In addition, in a case in which a group (a plurality of users L) visits the same place, the portable terminal device 10 of each user L may mutually check a position through the server 2. It is to be noted that, in a case in which the portable terminal device 10 is used in a Wi-Fi available area, the communication with the server 2 may be established through the Wi-Fi.

The device communicator 104 is a communication circuit that communicates with the headphones 20. The headphones 20 (a headphone communicator 27) has a communication function such as Bluetooth or Wi-Fi direct. The device communicator 104 may have the same communication function as the headphones 20.

The positioner 105 receives a GPS signal (a PN code) of a GPS (global positioning system), and measures an own position. The positioner 105 supplies measured position data to the position determiner 112. The positioner 105 may measure a position using other systems other than the GPS, or using the GPS and the other systems. The other systems include the Quasi-Zenith Satellite Michibiki or the BeiDou Navigation Satellite System, for example.

A configuration of the headphones 20 will be described with reference to the block diagram of FIG. 3. The headphones 20, as shown in FIG. 1, connect the right and left housings 21L and 21R by the arch-shaped headband 22. The left housing 21L includes a speaker 23L, an external microphone 26L, a headphone signal processor 24, and a headphone communicator 27. The right housing 21R includes a speaker 23R and an external microphone 26R. The headband 22 includes the gyro sensor 25.

The external microphones 26L and 26R are respectively provided on the outside of the right and left housings 21L and 21R. The external microphones 26L and 26R, if the user L had not worn the headphones 20, collect environmental sound (external sound) that would have probably reached the right and left ears of the user L. The speakers 23L and 23R are provided so that the ear canal of the user L may face the inside of each of the right and left housings 21L and 21R.

The headphone communicator 27 communicates with the portable terminal device 10 (the device communicator 104) by a communication method such as the above-described Bluetooth or Wi-Fi direct. The headphone communicator 27 receives a reproduced audio signal, an external sound control command, or the like, from the portable terminal device 10. In addition, the headphone communicator 27 sends a detection value or the like of the gyro sensor 25, to the portable terminal device 10.

The headphone signal processor 24 includes a digital processing circuit such as a DSP, and executes signal processing as described above, to an audio signal to be supplied to the speakers 23L and 23R. The signal processing includes the active noise cancellation processing, the hear-through processing, and processing (to be described in detail below) of hear-through sound. The signal processing also includes mixing of the hear-through sound or the cancellation sound with an audio signal received from the portable terminal device 10. The signal processor of the present disclosure corresponds to both the signal processor 102 of the portable terminal device 10 and the headphone signal processor 24.

FIG. 4 is a diagram showing an example of a map drawn on the basis of the map data 722. The map is a map showing the park 500 that is a place used as a setting for animation or the like. The park 500 is a destination of the contents tourism. In the map, the Y direction shown in FIG. 4 indicates north, and the X direction indicates east.
Reference numeral 503 denotes audience seats.

FIG. 5 is a diagram showing an example of the scenario file 721. The scenario file 721 includes a plurality of pieces of event information. Each piece of event information includes trigger information and processing information to be executed in the event. The processing information includes a mode of the external sound control, audio data to be reproduced, and all or a part of localization positions. The trigger information is information that indicates the timing (a trigger) of when to execute processing (an event) of event information. The trigger includes that a user has reached a predetermined point, that a user is moving on a predetermined route, that a user has stayed at a certain place for a predetermined period, and the like, for example. The controller 100, when detecting a trigger, executes an event based on the event information corresponding to the trigger. When the user L visits the park 500 and moves in the inside of the park 500, the sound reproducing system 1 executes an event according to a place or the like to which the user L has moved. The sound reproducing system 1 reproduces audio data, and performs external sound control. In the following description, the scenario file 721 may be called the scenario 721.

The map of FIG. 4 shows a portion of the park 500. The park 500 is a place used as a setting of animation. The park 500 includes an outdoor stage 502 and a pond 504. The animation includes a scene in which a plurality of characters (characters of animation) shoot a movie in each of the outdoor stage 502 and the pond 504. The user L moves around the park 500 according to route guidance by voice.

The user L enters the park 500 from a point P1, and exits the park 500 through routes R1 to R4. The routes R1 to R4 are connected by points P1 to P4, respectively. The route is branched at the point P4. When correctly answering a quiz given at the point P4, the user L is guided to the route R4, and, when incorrectly answering a quiz, the user L is guided to the route R5. Every time when the user L reaches the points P1 to P4, and every time when the user L passes the routes R1 to R5, the sound reproducing system 1, based on the scenario 721, reproduces sound according to each point and route, and switches the external sound control.

When the user L reaches the point P1 that is an entrance at the southwest corner of the park 500, the sound reproducing system 1 reproduces sound of the route guidance so as to guide the user L to follow the route R1 toward the point P2. The head-direction determiner 111 stores the direction of the route R1 as the initial head direction. At this time, the sound reproducing system 1 executes each of the active noise cancellation processing and the hear-through processing at the function level of 50%. The active noise cancellation processing at the function level of 50% is defined, for example, as processing in which leak sound to be transmitted from the housings 21L and 21R is reduced to a half level. Specifically, the active noise cancellation processing at the function level of 50% is processing to output a cancellation signal at the half level and cancelling leak sound only by half. The hear-through processing at the function level of 50% is a function of emitting external sound collected by the external microphones 26L and 26R from the speakers 23L and 23R at a half level of a case in which a user listens to the external sound directly (without the headphones 20). The sound reproducing system 1, when reproducing the route guidance, makes a guidance voice easy to hear while allowing the user L to experience realistic sensation by making the user L listen to the external sound at the place, by using both the active noise cancellation processing and the hear-through processing. It is to be noted that a ratio of combined use of the active noise cancellation processing and the hear-through processing is not limited to 50% and 50%. In addition, the sum of both ratios does not have to be 100%. For example, it is also possible to execute the hear-through processing by only 50% without operating the active noise cancellation processing at all (0%). The external sound control mode in which each of the active noise cancellation processing and the hear-through processing is executed at the function level of less than 100% is called an intermediate mode.

The signal processor 102 performs localization control so as to localize the sound of the route guidance on the side of the user L (a position one meter away at 90 degrees to the left with respect to the head direction, for example). In such a manner, the signal processor 102 performs the control so as to localize the sound of the route guidance not at a position fixed in the park 500 but at a position relative to the user L. As a result, the user L can listen to the route guidance with an auditory sense such that a guide accompanying the user L is talking.

The user L follows the route guidance and enters the park 500 along the route R1. In the route R1, the sound reproducing system 1 reproduces the commentary sound of the park 500 and the commentary sound of animation that uses the park 500 as a setting. At the time of reproduction of the commentary sound, the sound reproducing system 1 executes the active noise cancellation processing at the function level of 0% and the hear-through processing at the function level of 70%, and makes the realistic sensation of being in the park 500 higher than the realistic sensation at the time of the route guidance. The localization position of the commentary sound is a position one meter to the left of the user L as with the case of the route guidance.

The route R1 is a route from the point P1 at the entrance of the park 500 to the point P2 located behind the audience seats of the outdoor stage 502 in the park 500. When the user L walks along the route R1 and reaches the point P2, the sound reproducing system 1 reproduces the sound of the route guidance so that the user L may follow the route R2 toward the point P3 (the outdoor stage 502). At the time of reproduction of the route guidance, the sound reproducing system 1 executes each of the active noise cancellation processing and the hear-through processing at the function level of 50%. The localization position of the route guidance is a position one meter to the left of the user L, for example.

The route R2 is a route from the back of the audience seats of the outdoor stage 502 toward the outdoor stage 502. When the user L begins to walk along the route R2, the sound reproducing system 1 reproduces sound of animation so as to localize the sound of animation in the direction of the outdoor stage 502. The sound of animation reproduces a scene of animation by sound, for example, and includes the line of a character and BGM (background music). At the time of reproduction of the sound of animation, the sound reproducing system 1 executes the hear-through processing at the function level of 100%, and does not execute the active noise cancellation processing. In other words, the sound reproducing system 1 makes the user L listen to the sound of animation in the external sound (the environmental sound) of the park 500. The sound reproducing system 1 performs the localization control of the sound of animation according to the arrangement of a character on the outdoor stage 502. As a result, the user L can obtain a sense of immersion as if the user L views a scene of animation is being performed on the outdoor stage 502 in front of the own eyes. The external sound control mode in which the hear-through processing is executed at the function level of 100% and the active noise cancellation is not executed is called a hear-through mode.

The user L walks along the route R2 to the point P3, listening to the sound of animation. The point P3 is on the outdoor stage 502, and is a place in which animation under reproduction is being performed. When the user L reaches the point P3 and then stays at the point P3 for a predetermined period (one minute, for example), the sound reproducing system 1 changes the localization control of the sound of animation under reproduction, and the external sound control. The sound of animation includes the line of a plurality of characters. The sound reproducing system 1 causes the line of one (hereinafter referred to as Character A) of the characters to be localized in the head of the user L. The user L, since the line of Character A is reproduced in the own head, can obtain a sense of immersion as if the user L becomes Character A. The sound reproducing system 1 causes the line of other characters (hereinafter referred to as Characters B and C) to be localized at a predetermined position on the outdoor stage 502. The predetermined position is a place in which Characters B and C have performed at the scene of animation, for example. At the time of reproduction of the sound of animation at the point P3, the sound reproducing system 1 executes the active noise cancellation processing at the function level of 100%, and does not execute the hear-through processing. In other words, the sound reproducing system 1 makes the user L listen to only the sound of animation. As a result, the user L can obtain a sense of immersion as if the user L plays Character A and performs one scene of animation together with the other Characters B and C. The external sound control mode in which the active noise cancellation processing at the function level of 100%, and the hear-through processing is not executed is called a noise cancellation mode.

It is to be noted that, when a group of a plurality of users visits the outdoor stage 502, the sound reproducing system 1 is also able to assign each user to each of Characters A, B, and C, and stage a performance such that the group plays one scene of animation. The processing operation of the sound reproducing system 1 and the server 2 in a case in which a plurality of users visit the park 500 will be described below.

After the reproduction of the sound of animation is completed, the sound reproducing system 1 reproduces the sound of route guidance so as to allow the user L to follow the route R3 toward the point P4. At the time of reproduction of the route guidance, the sound reproducing system 1 performs each of the active noise cancellation processing and the hear-through processing at the function level of 50%. The localization position of the route guidance is a position one meter to the left of the user L, for example.

The route R3 is a route from the point P3 on the outdoor stage 502 to the point P4 through the side of the audience seats. The point P4 is a boundary point between an area including the outdoor stage 502 and an area including the pond 504. The sound reproducing system 1, in the route R3, sets the headphones 20 to the hear-through processing at 100% and the active noise cancellation processing at 0%. As a result, the user L can slowly listen to the environmental sound of the park 500, such as the voice of a bird and the murmur of leaves. At such a time, the sound reproducing system 1 may reproduce BGM according to a season or time of a day, with low sound volume.

When the user L reaches the point P4, the sound reproducing system 1 gives a quiz to the user L. The quiz is included in the audio data set 723 as audio data. The sound generator 113 gives a quiz to the user L by reproducing the audio data set 723. At the time of the quiz, the sound reproducing system 1 executes the active noise cancellation processing at the function level of 100% and the hear-through processing at the function level of 0%. The localization position of quiz sound is a position one meter to the front of the user L.

The quiz is preferably a question about the content of animation, for example. The user L operates the screen of the portable terminal device 10, and answers to the quiz. The method of answering to a quiz is not limited to a screen operation of the portable terminal device 10. For example, the user may answer a quiz by a method such as walking in the direction that the user L thinks is correct or turning the head in the direction that the user L thinks is correct.

When the user L correctly answers a quiz, the sound reproducing system 1 reproduces the sound of the route guidance so as to allow the user L to follow the route R4. On the other hand, when the user L incorrectly answers a quiz, the sound reproducing system 1 reproduce the sound of the route guidance so as to allow the user L follow the route R5. At the time of reproduction of the route guidance, the sound reproducing system 1 executes each of the active noise cancellation processing and the hear-through processing at the function level of 50%. The localization position of the route guidance is a position one meter to the left of the user L, for example.

The route R4 is a route that goes around the pond 504 from the point P4, and exits from the park 500 through a passage on the east side. When the user L correctly answers the quiz and follows the route R4, the sound reproducing system 1 reproduces the sound of animation so as to localize the sound on an island 505 located in the center of the pond 504. The sound reproducing system 1 executes the hear-through processing at the function level of 70% and the active noise cancellation processing at the function level of 100%. Further, the sound reproducing system 1 executes signal processing on hear-through sound being external sound to be reproduced by the hear-through processing and processes the hear-through sound to obtain warm sound quality. The warm sound quality is sound quality that extends the dynamic range of sound and attenuates the high audio frequencies by a low-pass filter with gentle characteristics, for example. The sound reproducing system 1 mixes the sound of animation, filtered external sound, and cancellation sound, and emits mixed sound from the speakers 23L and 23R.

The user L goes around the pond 504 while listening to the sound of animation and the filtered external sound that have been processed into the warm sound quality by the signal processing. The pond 504 includes a fountain, so that the user L may listen to the sound of animation against the background of sound of the fountain. The user L leaves the park 500, going around the pond 504 while listening to the sound of animation.

The route R5 is a route that exits from the park 500 through a passage on the east side from the point P4. When the user L incorrectly answers a quiz and follows the route R5, the sound reproducing system 1 outputs horror sound obtained by filtering the external sound. When the user L incorrectly answers a quiz and follows the route R5, the sound reproducing system 1 executes the active noise cancellation processing at the function level of 100% and also executes the hear-through processing at the function level of 100%. Further, the sound reproducing system 1 executes signal processing on hear-through sound, and processes the hear-through sound to obtain horror sound quality. The horror sound quality is, for example, the sound quality obtained by extremely cutting high-pitched sound and applying tape echo to the high-pitched sound. The tape echo is filter processing with delayed one or a plurality of peaks.

The user L, when having correctly answered a quiz, listens to the sound of animation in the route R4. However, when having correctly answered a quiz, the user L listens to only horror external sound in the route R5. In such a manner, the content data 72 (the scenario 721) is edited so that the route may be branched and sound processing may be different, depending on whether the quiz is answered correctly or incorrectly.

Figure 6:
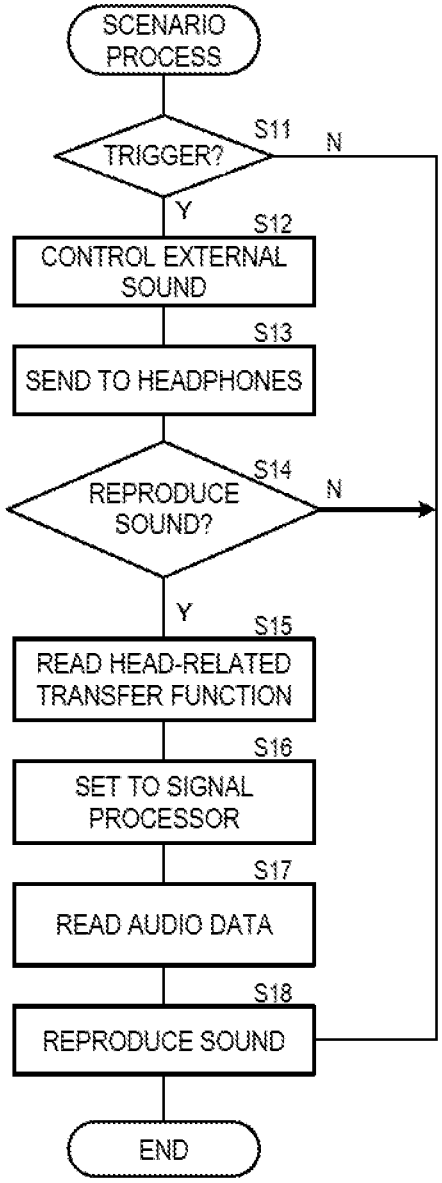
FIG. 6 is a flow chart showing a scenario progress process of a sound reproducing system.

FIG. 6 is a flow chart showing an operation in which the controller 100 performs a process based on the scenario 721. The process is repeatedly executed at regular time (one second, for example) intervals. The controller 100 determines whether a trigger of any of the events described in the scenario 721 has occurred (Step S11 and Step Sn are hereinafter simply referred to as Sn). If the trigger does not occur (NO in S11), the controller 100 ends the current operation. If the trigger occurs (YES in S11), the controller 100 reads external sound control information of corresponding event data (S12), and sends the information to the headphones 20 as an external sound control command (S13). The external sound control information includes the active noise cancellation processing, the hear-through processing, and the signal processing on hear-through sound. The controller 100 determines whether audio data to be reproduced is present (S14). In a case in which no audio data to be reproduced is present (NO in S14), the controller 100 ends the operation.

In a case in which audio data to be reproduced is present (YES in S14), the controller 100 first reads a head impulse response corresponding to the localization position of sound to be reproduced from the filter coefficient 71 (S15), and sets the response to the signal processor 102 (S16). The controller 100 reads the audio data to be reproduced (S17), and reproduces sound (S18). The device communicator 104 sends the sound that has been reproduced and localized, to the headphones 20.

The process of the flow chart shown in FIG. 6 may be performed in a random order to the extent that the content of the process is not changed.

A process of the sound reproducing system 1 in a case in which a group, that is, a plurality of users visit the park 500 together will be described. The plurality of users (three users in this example) are defined by a user L1, a user L2, and a user L3, respectively, and the user L1 is defined as a leader of the group.

Each of the users L1, L2, and L3 forms a group through the server 2 or through direct two-way communication. For example, in a case of the server 2, the user L1 creates a group on the server 2 and recruits a company. At this time, the user L1 becomes a leader. The users L2 and L3 participate in the group, and the group is formed. Each of the server 2 and the portable terminal device 10 of each user L1, L2, and L3 register a member of the group into a group table. In addition, in a case of the direct two-way communication, the user L1 uses the own portable terminal device 10, and sends a message to invite to join the group, to the portable terminal device 10 of other users L2 and L3. When the users L2 and L3 send a reply to the message using the own portable terminal device 10, the group is formed. The portable terminal device 10 of each user L1, L2, and L3 registers a member of the group into the group table. In addition, the server 2 may register the group and the member of the group. The communication between the portable terminal devices 10 of each user L1, L2, and L3 may be performed by a communication method such as Bluetooth or Wi-Fi direct, for example.

When the group is formed, the members of the group decide a place to visit together in the contents tourism. When the place to visit has been determined, the portable terminal device 10 of each user L1, L2, and L3 downloads content data 72 of the determined place, from the server 2. The members of the group go to a destination (the park 500, for example) of the contents tourism together. In the park 500, the portable terminal device 10 of each user L1, L2, and L3 progresses the scenario 721 in a position measured in the own device. It is to be noted that each user L1, L2, and L3 does not separately progress the scenario 721, but instead the scenario 721 of all the members (the users L1, L2, and L3) may be synchronously advanced on the basis of the position that the portable terminal device 10 of the user L1 who is the leader has measured.

In the point P3 on the outdoor stage 502 of the event No. 5 shown in FIG. 5, each member progresses the scenario 721 together. In other words, the portable terminal device 10 of the users L1, L2, and L3 progresses the scenario 721 in synchronization with the progresses (reproduction of the sound of animation) of the scenario 721 of the portable terminal device 10 of the user L1.

On the outdoor stage 502, first, a role (which character to play) of each member is determined. The server 2 or the portable terminal device 10 of the user L1 who is the leader may automatically determine a role, or each user L1, L2, and L3 may report and decide a role. Each user L1, L2, and L3 may report, for example, by tapping any of a plurality of characters displayed on the portable terminal device 10 and notifying the portable terminal device 10 of other members that a member tapping a character will perform the tapped character.

The portable terminal device 10 of each user determines localization of the line of each of the plurality of characters. In other words, the line of the character of which the user is in charge is localized in the head of the user, and the line of the character of which a different user is in charge is localized in a position in which the character of which the different user is in charge is present. The position of the user is shared by the server 2 or by direct communication.

As described above, the sound reproducing system 1, when the plurality of users perform an event, further produces a performance effect of the point P3. Each of the plurality of users is in charge of a character, and the sound reproducing system 1 reproduces the sound of a line based on the scenario 721. As a result, although a user does not necessarily speak the line, each user can experience Augmented Reality in which the user becomes a character of animation, which makes it possible to increase a sense of immersion of the contents tourism.

In addition, in the quiz of the event No. 8, the answer of the leader represents the answer of all the members. In other words, the sound reproducing system 1 guides all the members to the route R4 when the leader answers correctly, and guides all the members to the route R5 when the leader answers incorrectly. Alternatively, in an opposite manner, the portable terminal device 10 of each user may adopt the answer of the member of the group, and may guide all the members to a route based on the adopted answer. In such a case, the sound reproducing system 1, since separately guiding each user to the route R4 or the route R5 depending on the correctness or incorrectness of the answer to the quiz, is able to temporarily separate the group.

The above embodiment describes a case in which the sound reproducing system 1 is applied to the contents tourism. The sound reproducing system 1 of the embodiment is also applicable to content other than the contents tourism. For example, the sound reproducing system 1 of the embodiment is applicable to a haunted house, an escape game, the exhibition guide of an art museum, or the like.

In a haunted house, the sound reproducing system 1 executes the active noise cancellation processing at the function level of 100%, and is able to increase the sense of fear by creating a situation in which the user L can hear nothing. Similarly in an escape game, the sound reproducing system 1 may execute the active noise cancellation processing at the function level of 100% in a maze. When the user L was able to escape, the sound reproducing system 1 performs the active noise cancellation processing at 0%, and is able to increase the sense of openness when the user L was able to escape by making the user L listen to surrounding sound.

In a case in which a user sets the external sound control of the headphones 20 to the active noise cancellation processing at 100% and the hear-through processing at 0% by a manual operation, the portable terminal device 10 may compulsorily execute the hear-through processing. The portable terminal device 10, when determining that a user comes to a place that is considered dangerous for the user, such as a crossing, compulsorily executes the hear-through processing. Alternatively, the portable terminal device 10 may compulsorily execute the hear-through processing when an external microphone 26 collects a siren, a horn, the voice of a person, or the like.

As stated in the description of FIG. 4, the sound reproducing system 1, in the hear-through processing, not only emits the hear-through sound from the speakers 23L and 23R but also may emit the sound after executing signal processing such as filtering. As a result, the sound reproducing system 1 is able to cause the sound to have a different atmosphere from a case in which the hear-through sound is heard as it is. For example, the processing to the hear-through sound includes filtering, echo, and reverberation. An effect to be applied to the hear-through sound may include adding sound quality as if a user were in a cave (despite walking in a park).

The sound reproducing system 1 not only instantly performs the switching of the external sound control but also may gradually perform the switching of the external sound control, that is, may perform the switching by fading.

The trigger to instruct the execution of an event is not limited to the movement that the user L has made to a predetermined position. For example, the trigger may include the current time, the operation (the direction of the head, the number of steps, a movement speed, or time during stop) of the user. In addition, the sound reproducing system 1 is able to demand a plurality of times of visits and a revisit with respect to the user L by providing a trigger that is not implemented if the user does not come at an applicable time such as an evening or a fall.

In the above embodiment, the three-axis gyro sensor 25 and the positioner 105 such as the GPS are used as a component to detect the head direction and position of the user L. The component to detect the head direction and position of the user L is not limited to such a component. For example, in place of the three-axis gyro sensor 25, a six-axis gyro sensor including a three-axis gyro sensor and a three-axis acceleration sensor (motion sensor) may be used. When such a six-axis gyro sensor is used and the initial position of the user L is determined, the position determiner 112 is able to determine a position along with the movement of the user L even at a place at which positioning such as the GPS is impossible.

Further, in place of the three-axis gyro sensor 25, a nine-axis sensor including a three-axis direction sensor (compass) in addition to the three-axis gyro sensor and the three-axis acceleration sensor may be used. When such a nine-axis sensor is used, the head-direction determiner 111 is able to correct an integrated value of the gyro sensor with reference to a detection value of the direction sensor as necessary, and eliminate an integration error. The head-direction determiner 111 may execute control of the localization direction of sound, using the integrated value of a gyro sensor having good response characteristics.

The description of the present embodiments is illustrative in all points and should not be construed to limit the present disclosure. The scope of the present disclosure is defined not by the foregoing embodiments but by the scope of claims of patent. Further, the scope of the present disclosure is intended to include all modifications within the scopes of the claims of patent and within the meanings and scopes of equivalents. For example, the headphones 20 may include a configuration corresponding to the controller 100 and the storage 101. In such a case, the headphones 20 serve as an example of the sound reproducing apparatus of the present disclosure.

What is claimed is:

1. A sound reproducing apparatus comprising:

a speaker that emits sound toward an ear of a user;

a microphone that collects external sound arriving at the user; and at least one processor that performs a process by reading and executing instructions stored in a memory, the process comprising:

a signal processing task that executes:

hear-through processing that supplies the external sound to the speaker; and noise cancellation processing that generates cancellation sound that cancels the external sound and that supplies the cancellation sound to the speaker;

a storage task that stores:

control information that specifies a function level of each of the hear-through processing and the noise cancellation processing; and event information that includes information on a trigger that is an event that instructs event execution; and a reading task that, when detecting an occurrence of the trigger, reads control information of the event information of which execution is instructed by the trigger, and executes the hear-through processing and the noise cancellation processing in the signal processing task, wherein the control information includes information that instructs adjustment of sound quality of the external sound supplied to the speaker by the hear-through processing; and the signal processing task, when receiving the information that instructs the adjustment of the sound quality of the external sound as the control information, executes processing that adjusts the sound quality of the external sound based on the control information.

2. The sound reproducing apparatus according to claim 1, wherein the control information includes information that controls the signal processing task in any of:

(i) a noise cancellation mode in which the noise cancellation processing is executed at 100% and the hear-through processing is not executed;

(ii) a hear-through mode in which the noise cancellation processing is not executed and the hear-through processing is executed at 100%; and (iii) an intermediate mode in which the noise cancellation processing is executed at less than 100% and the hear-through processing is executed at less than 100%.

3. The sound reproducing apparatus according to claim 1, wherein the signal processing task, when switching the function level of the noise cancellation processing or the hear-through processing, switches the function level while gradually changing the function level.

4. The sound reproducing apparatus according to claim 1, wherein the event information includes audio data; and the process further comprises:

a reproduction task that, when detecting the occurrence of the trigger, reads control information of the event information of which the execution is instructed by the trigger and outputs the control information to the signal processing task, and reproduces the audio data of the event information and outputs reproduced sound as internal sound; and a supply task that mixes the internal sound that has been outputted in the reproduction task, with the external sound and/or the cancellation sound, and supplies mixed sound to the speaker.

5. The sound reproducing apparatus according to claim 4, wherein the storage task stores a plurality of pieces of event information edited as a scenario in order to provide a guide to a place related to animation, a movie, or a drama.

6. A sound reproducing method comprising:

emitting sound toward an ear of a user, using a speaker;

collecting external sound arriving at the user, using a microphone;

executing, using at least one processor:

hear-through processing that supplies the external sound to the speaker; and noise cancellation processing that generates cancellation sound that cancels the external sound and that supplies the cancellation sound to the speaker;

storing, in a storage:

control information that specifies a function level of each of the hear-through processing and the noise cancellation processing, and event information including information on a trigger that is an event that instructs event execution; and reading, when an occurrence of the trigger is detected, control information of the event information of which execution is instructed by the trigger, and executing the hear-through processing and the noise cancellation processing, wherein the control information includes information that instructs adjustment of sound quality of the external sound supplied to the speaker by the hear-through processing; and the hear-through processing and the noise cancellation processing, when receiving the information to instruct the adjustment of the sound quality of the external sound as the control information, execute processing to adjust the sound quality of the external sound based on the control information.

7. The sound reproducing method according to claim 6, wherein the control information includes information that performs control in any of:

(i) a noise cancellation mode in which the noise cancellation processing is executed at 100% and the hear-through processing is not executed;

(ii) a hear-through mode in which the noise cancellation processing is not executed and the hear-through processing is executed at 100%; and (iii) an intermediate mode in which the noise cancellation processing is executed at less than 100% and the hear-through processing is executed at less than 100%.

8. The sound reproducing method according to claim 6, further comprising switching the function level while gradually changing the function level, when switching the function level of the noise cancellation processing or the hear-through processing.

9. The sound reproducing method according to claim 6, wherein the event information further stores audio data; and the method further comprises reproducing the audio data and supplying reproduced audio data to the speaker, in the hear-through processing and the noise cancellation processing.

10. The sound reproducing method according to claim 9, wherein the storing includes storing a plurality of pieces of event information edited as a scenario in order to provide a guide to a place related to animation, a movie, or a drama.

11. A sound reproducing system comprising:

a sound reproducing apparatus; and a portable terminal device, wherein the sound reproducing apparatus comprises:

a speaker that emits sound toward an ear of a user;

a microphone that collects external sound arriving at the user; and a first processor that performs a process by reading and executing instructions stored in a memory, the process comprising signal processing task that executes hear-through processing that supplies the external sound to the speaker, and noise cancellation processing that generates cancellation sound that cancels the external sound and that supplies the cancellation sound to the speaker, the portable terminal device comprising a second processor that performs a second process by reading and executing instructions stored in a memory, the second process comprising:

a storage task that stores control information that specifies a function level of each of the hear-through processing and the noise cancellation processing, and event information including information on a trigger that is an event that instructs event execution; and a reading task that, when detecting an occurrence of the trigger, by reading control information of the event information of which execution is instructed by the trigger and outputting the control information to the sound reproducing apparatus, causes the signal processing task to execute the hear-through processing and the noise cancellation processing, wherein the control information includes information that instructs adjustment of sound quality of the external sound supplied to the speaker by the hear-through processing; and the signal processing task, when receiving the information that instructs the adjustment of the sound quality of the external sound as the control information, executes processing that adjusts the sound quality of the external sound based on the control information.

12. The sound reproducing system according to claim 11, wherein the control information includes information that controls the signal processing task in any of:

(i) a noise cancellation mode in which the noise cancellation processing is executed at 100% and the hear-through processing is not executed;

(ii) a hear-through mode in which the noise cancellation processing is not executed and the hear-through processing is executed at 100%; and (iii) an intermediate mode in which the noise cancellation processing is executed at less than 100% and the hear-through processing is executed at less than 100%.

13. The sound reproducing system according to claim 11, wherein the signal processing task, when switching the function level of the noise cancellation processing or the hear-through processing, switches the function level while gradually changing the function level.

14. The sound reproducing system according to claim 11, wherein the event information includes audio data;

the second processor, when detecting the occurrence of the trigger, reads control information of the event information of which the execution is instructed by the trigger and outputs the control information to the sound reproducing apparatus, and reproduces the audio data of the event information and outputs reproduced sound as internal sound to the sound reproducing apparatus; and the signal processing task mixes the internal sound that has been outputted to the sound reproducing apparatus, with the external sound and/or the cancellation sound, and supplies mixed sound to the speaker.

15. The sound reproducing system according to claim 14, wherein the storage task stores a plurality of pieces of event information edited as a scenario in order to provide a guide to a place related to animation, a movie, or a drama.

* * * * *